US008167679B2

(12) United States Patent
Seraceno et al.

(10) Patent No.: US 8,167,679 B2
(45) Date of Patent: May 1, 2012

(54) BREAST SUPPORTER

(75) Inventors: Paula Seraceno, Denver, CO (US); Karen McLeod, Simi Valley, CA (US)

(73) Assignee: Savvy Enterpise, LLC, Denver, CO (US)

( * ) Notice: Subject to any disclaimer, the term of this patent is extended or adjusted under 35 U.S.C. 154(b) by 0 days.

(21) Appl. No.: 12/724,245

(22) Filed: Mar. 15, 2010

(65) Prior Publication Data

US 2010/0190411 A1 Jul. 29, 2010

Related U.S. Application Data

(63) Continuation of application No. 11/295,992, filed on Dec. 5, 2005, now abandoned.

(51) Int. Cl.
*A41C 3/00* (2006.01)

(52) U.S. Cl. ..... 450/86; 450/58; 450/79

(58) Field of Classification Search ..... 450/63, 450/1, 64, 4, 41, 43–45, 86, 88, 70, 75, 77, 450/79, 7–10, 14–16, 55–62, 19–28, 80, 450/82; 2/67, 73

See application file for complete search history.

(56) References Cited

U.S. PATENT DOCUMENTS

| | | | | |
|---|---|---|---|---|
| 525,241 | A | 8/1894 | Tucek | |
| 1,242,118 | A | 8/1917 | Anderman | |
| 1,290,608 | A | 1/1919 | Lowman | |
| 1,878,755 | A | 9/1932 | Caldor | |
| 2,100,890 | A | 11/1937 | Witkower | |
| 2,118,378 | A | 5/1938 | Graham | |
| 2,378,907 | A | 6/1945 | Blum | |
| 2,378,908 | A | 6/1945 | Blum | |
| 2,388,757 | A | 11/1945 | Miller | |
| 2,440,922 | A | 5/1948 | Algon | |
| 2,455,036 | A | 11/1948 | Boylan | |
| 2,509,353 | A | 5/1950 | Johnson | |
| 2,521,373 | A | 9/1950 | Hutchison | |
| 2,650,363 | A | 9/1953 | Cascio | |
| 3,109,431 | A | 11/1963 | Jefferson | |
| 3,131,696 | A | 5/1964 | Krakower | |
| 3,306,299 | A | 2/1967 | Paramore | |
| 3,311,112 | A | 3/1967 | Murray | |
| 3,411,508 | A | 11/1968 | Sayers | |
| 3,465,754 | A | 9/1969 | Lockwood et al. | |
| 3,934,593 | A | 1/1976 | Mellinger | |
| 3,935,865 | A | 2/1976 | Newmar | |
| D240,771 | S | 8/1976 | Lipton | |
| 4,220,157 | A | 9/1980 | Clark et al. | |
| 4,300,568 | A | 11/1981 | Blanckmeister | |
| D300,980 | S | 5/1989 | Mathis | |
| D358,247 | S | 5/1995 | Nishiba | |
| 5,914,166 | A | 6/1999 | Le | |
| 5,983,393 | A | 11/1999 | Walton | |
| 6,023,785 | A * | 2/2000 | Johnson | 2/62 |
| 6,200,194 | B1 | 3/2001 | Grier | |

(Continued)

OTHER PUBLICATIONS

Information Disclosure Statement filed Dec. 5, 2005 in U.S. Appl. No. 11/295,992.

(Continued)

*Primary Examiner* — Gloria Hale

(74) *Attorney, Agent, or Firm* — Lee G. Meyer, Esq.; Meyer & Associates, LLC

(57) ABSTRACT

Disclosed herein is a breast supporter for properly and comfortable supporting breasts.

18 Claims, 10 Drawing Sheets

U.S. PATENT DOCUMENTS

| | | | | |
|---|---|---|---|---|
| 6,257,951 | B1 | 7/2001 | Demarco | |
| 6,257,952 | B1 | 7/2001 | Valentin | |
| 6,280,287 | B1 * | 8/2001 | Keith et al. | 450/1 |
| 6,293,844 | B1 | 9/2001 | Dalton | |
| 6,302,761 | B1 | 10/2001 | Wrenn | |
| 6,390,885 | B1 * | 5/2002 | Brooks | 450/1 |
| 6,422,917 | B1 | 7/2002 | Rose et al. | |
| 6,547,636 | B1 | 4/2003 | Cato | |
| 6,896,582 | B2 | 5/2005 | Kawami | |
| 7,168,096 | B1 | 1/2007 | Landa | |

OTHER PUBLICATIONS

Amendment Pursuant 37 CFR 1.115 filed Aug. 2, 2006 in U.S. Appl. No. 11/295,992.

Notice of Publication of Application issued Jun. 7, 2007 in U.S. Appl. No. 11/295,992.

Non-Final Rejection dated Oct. 4, 2007 in U.S. Appl. No. 11/295,992.

Amendment Pursuant 37 CFR 1.111 filed Mar. 4, 2008 in U.S. Appl. No. 11/295,992.

Non-Final Rejection dated Mar. 9, 2009 in U.S. Appl. No. 11/295,992.

Amendment Pursuant to 37 CFR 1.111 filed May 30, 2009 in U.S. Appl. No. 11/295,992.

Final Rejection dated Sep. 16, 2009 in U.S. Appl. No. 11/295,992.

Abandonment dated Mar. 26, 2010 in U.S. Appl. No. 11/295,992.

* cited by examiner

BREAST SUPPORTER

CROSS-REFERENCE TO RELATED APPLICATIONS

The present application is a Continuation Application of U.S. application Ser. No. 11/295,992 filed Dec. 5, 2005 for "BREAST SUPPORTER," now abandoned.

BACKGROUND

Women often get headaches, backaches, neck pain, shoulder pain and rib pain from the use of breast supporter. Women are constantly pulling, tugging, tightening and loosening their breast supporter trying to remove the pain and/or improve the operation of the breast supporter.

Traditional elements of breast supporters, such as an under wire sewn into the cup, fail to properly support the breasts. Other traditional elements (e.g. elastic band around the torso, strap configurations. adhesives and the like) have failed to fully address the underlying need to properly support the breasts. One traditional configuration incorporates a shoulder strap attached to one of the cups (and a mirror strap attached to the opposite cup; it should be noted that this is only one of the straps, but the mirror strap is attached in a similar fashion). This shoulder strap attaches to the cup at the top of the cup and runs over the shoulder and straight down to the elastic band positioned around the torso. The weight of the breast pulls the cup and strap in a downward direction. This movement causes the portion of the shoulder strap located on the backside of the wearer to move in an upwards direction. The elastic band around the torso is pulled in the upward direction as a result of the downward movement of the breast. This movement causes women to constantly pull the elastic torso band down in order to keep the cups supporting the breasts. As this process continues through the course of a day, the wearer is constantly adjusting and/or repositioning the breast supporter to counteract the movement. The weight of the breasts and improper support thereof can cause a tremendous amount of discomfort, causes improper posture and may cause pain.

SUMMARY OF THE INVENTION

Disclosed herein is one exemplary embodiment of a breast supporter including a first cup: a second cup adjacent to the first cup; a first strap comprising a first distal end and an oppositely disposed second distal end; wherein the first strap first distal end is attached to the first cup; and wherein the first strap second distal end is attached to the second cup.

Disclosed herein is another exemplary embodiment of a breast supporter including a first cup; a second cup adjacent to the first cup; a first strap comprising a first distal end and an oppositely disposed second distal end; wherein the first strap first distal end is attached to the first cup: wherein the first strap second distal end is attached to the second cup; a second strap comprising a first distal end and an oppositely disposed second distal end; wherein the second strap first distal end is attached to the second cup; wherein the second strap second distal end is attached to the first cup; and a first point of adjustment adjacent to the cups.

Disclosed herein is an exemplary method of inventorying breast supporters including providing a first group of a first cup size of the breast supporters: providing a second group of a second cup size of the breast supporters; and wherein the first cup size is different then the second cup size.

BRIEF DESCRIPTION OF THE DRAWINGS

Figures of the Drawing of one exemplary embodiment include.

DETAILED DESCRIPTION

Disclosed herein is a breast supporter for supporting the breasts of a user. As used herein the term "breast supporter" may refer to any article of clothing that is worn by a person for supporting one's breasts. Some examples of articles of clothing that support breasts are: a dress, a bra, a brazier, a swimsuit, a bikini, an undergarment, lingerie, or the like.

Figure 1:
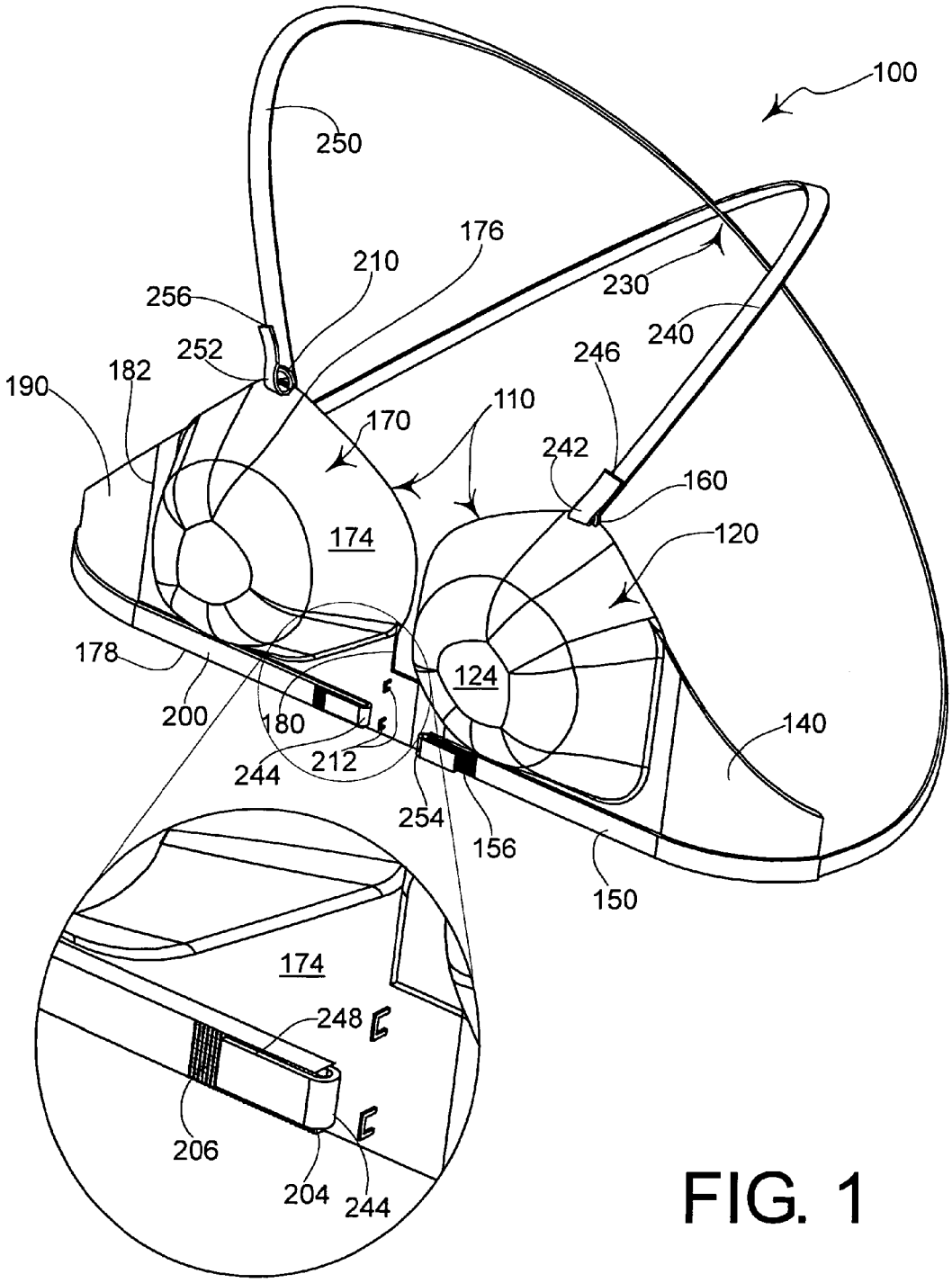
FIG. 1 shows an exemplary breast supporter in a front-side perspective view in which a portion is enlarged to show a detailed portion thereof.
Figure 2:
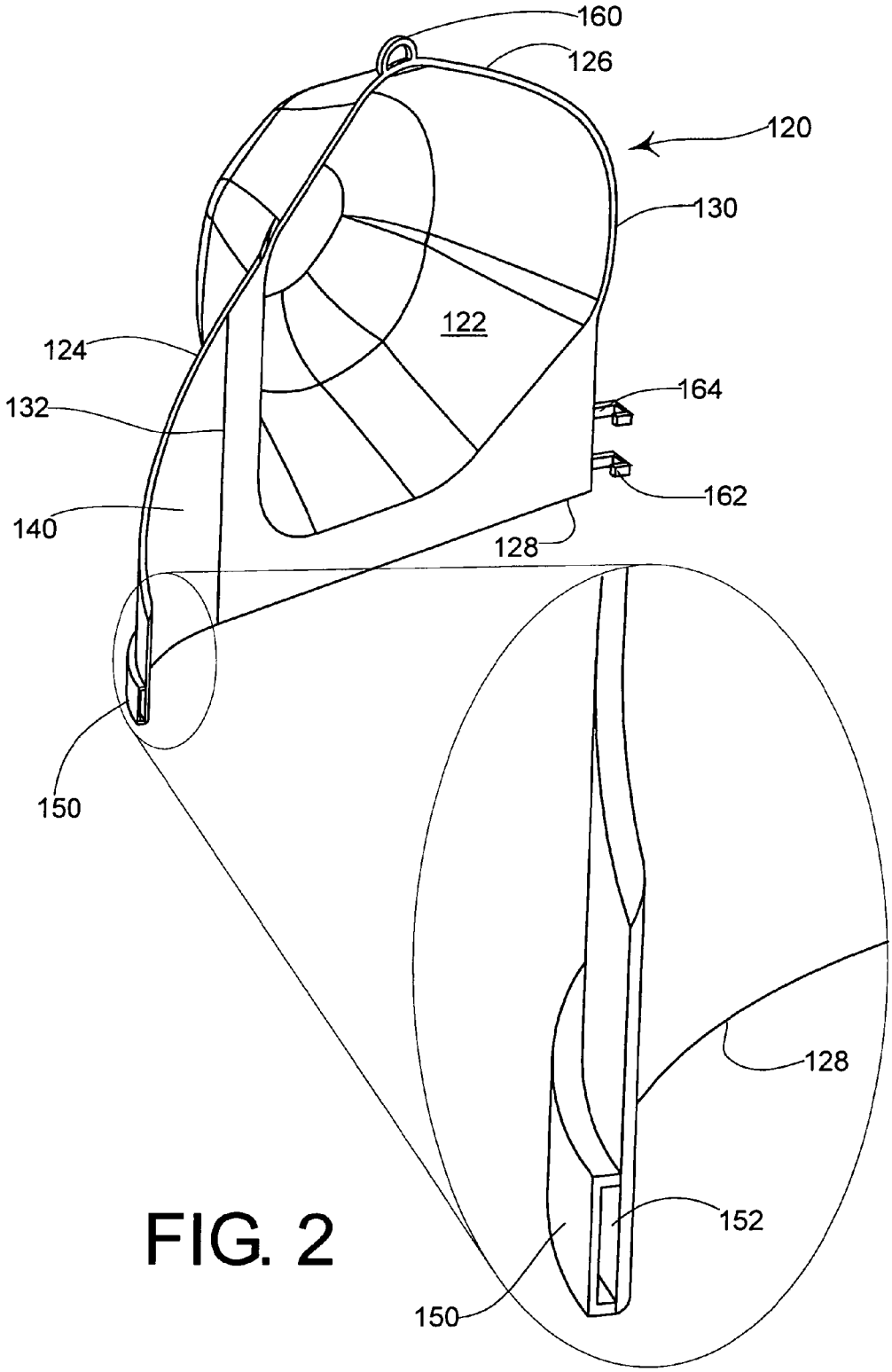
FIG. 2 shows a back-side perspective view and a detailed portion of one exemplary cup of the breast supporter illustrated in FIG. 1.

With reference to FIG. 1 showing a front perspective view of a breast supporter 100, the breast supporter 100 includes a pair of cups 110 and a strap assembly 230. The pair of cups 110 consists of a first cup 120 and a second cup 170. These cups 120, 170 may be made from any of a variety of materials or combinations of materials such as, but not limited to, elastic and inelastic materials (e.g. natural, synthetic and blends of materials). One such material is spandex (a synthetic fiber or fabric made from a polymer containing polyurethane). Other suitable materials, for example, are tricot, cotton, wool, etc. The first cup 120 may include an inside surface 122 (FIG. 2) and an oppositely disposed outside surface 124. It is to be noted that terms of utilized to describe orientation, e.g. inside, outside, upper, lower, front, back, etc, are used for descriptive purposes only and alternative orientations may be utilized. With reference to FIG. 2 showing a back perspective view of the first cup 120, the first cup 120 may define a top portion 126, a bottom portion 128, a first edge 130 and a second edge 132. The top portion 126 may be oppositely disposed from the bottom portion 128. The first edge 130 may be oppositely disposed from the second edge 132. The first cup 120 may be provided with an integrally formed torso portion 140 attached at the second edge 132. As illustrated in FIG. 2, this torso portion 140 may be formed in a manner that allows it to "wrap" around the torso of the wearer in a manner that will be described later herein.

Figure 3:
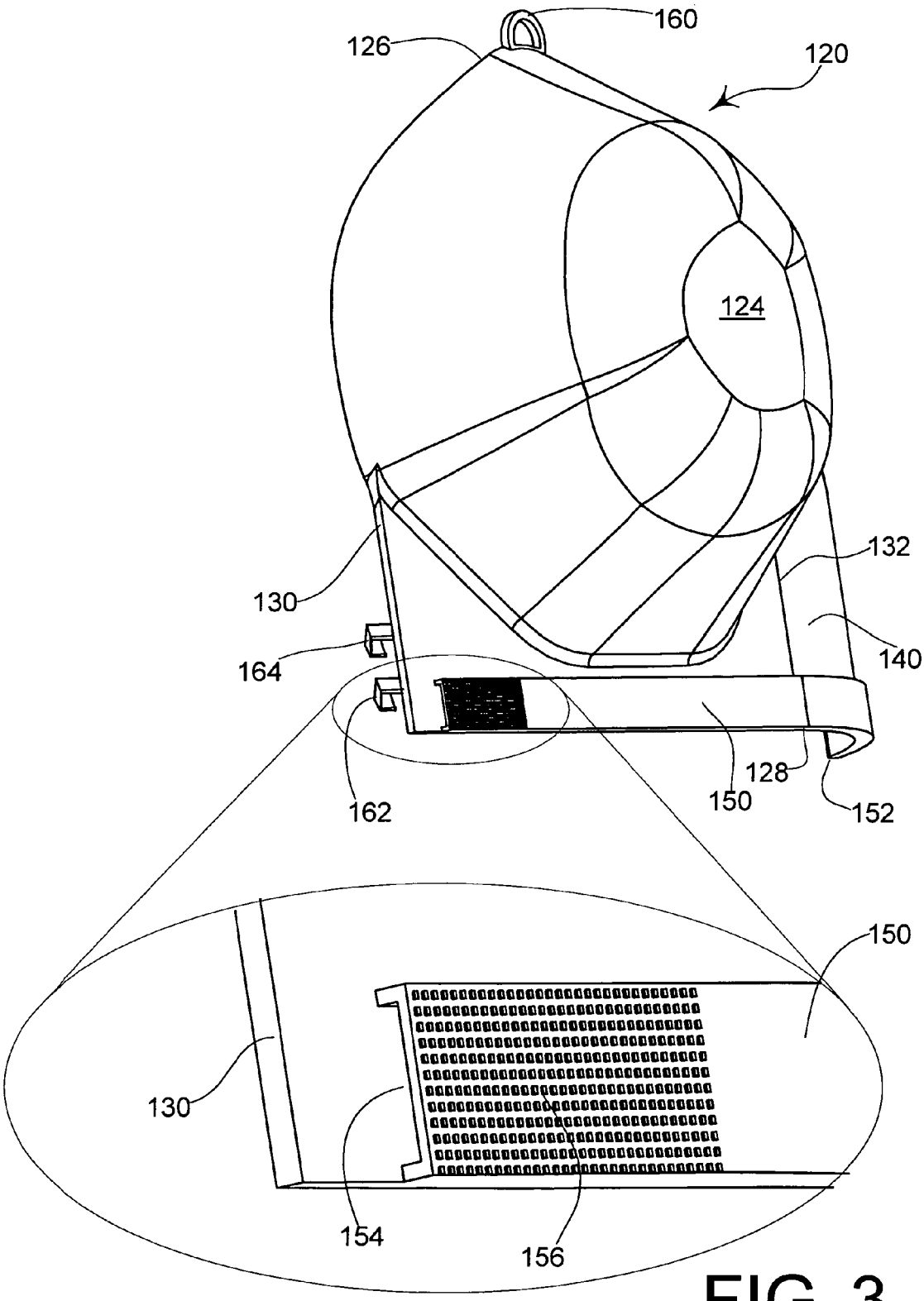
FIG. 3 shows a front-side perspective view and a detailed portion of the exemplary cup of the breast supporter of FIG. 2.

As illustrated in FIGS. 2 and 3, the first cup 120 may be provided with a casing 150 formed therein near the bottom portion 128 of the first cup 120 and extend into the torso section 140. This first cup casing 150 may, for example, be formed by folding the material of the first cup 120 onto itself thereby creating a hollow 'tube' (referred to herein as a casing). This casing 150 extends from the distal end of the first cup torso portion 140 to the first cup first edge 130. For descriptive purposes. the casing 150 will be described as having a first distal end 152 located at the first cup torso portion 140 and a second distal end 154 located at the first cup first edge 130. With reference to FIG. 3 showing a detailed section of the first cup casing second distal end 154, the casing 150 may be provided with a portion of fastener 156 such as, for example, hook-and-loop material. This fastener 156 may be permanently attached to the casing 150 by common manufacturing processes such as, for example, heat tape, stitching, or the like. Furthermore, this fastener 156 may be referred to herein as a 'point of adjustment'. With continued reference to FIG. 2, the first cup 120 may be further provided with an attachment point 160 formed near the top portion 126. In one exemplary embodiment, the attachment point 160 may be a loop captured by the materials used to construct the breast supporter 100. Other exemplary attachment points include, but are not limited to: clasps, snaps, buttons, tabs, removable rivets, safety pins, clamps, buckles, etc. Additionally, the first cup 120 may be provided with a first eye 162 and a second eye 164. These eyes 162, 164 may be attached to the inside surface 122 of the first cup 120 near the first edge 130.

Figure 4:
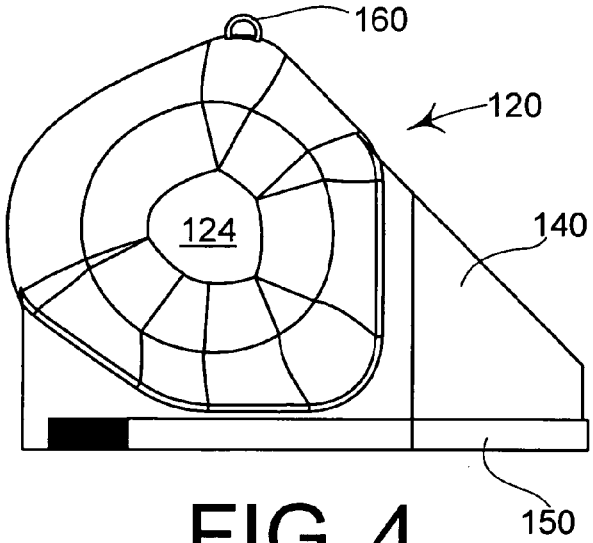
FIG. 4 shows a front elevation view of the exemplary cup of the breast supporter illustrated in FIG. 2.
Figure 5:
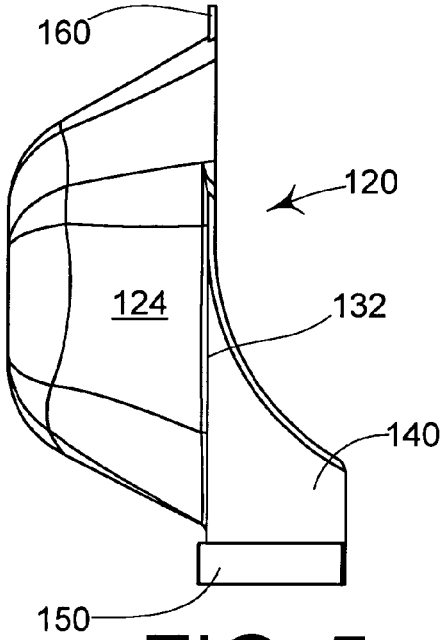
FIG. 5 shows a side elevation view of the exemplary cup of the breast supporter illustrated in FIG. 2.
Figure 6:
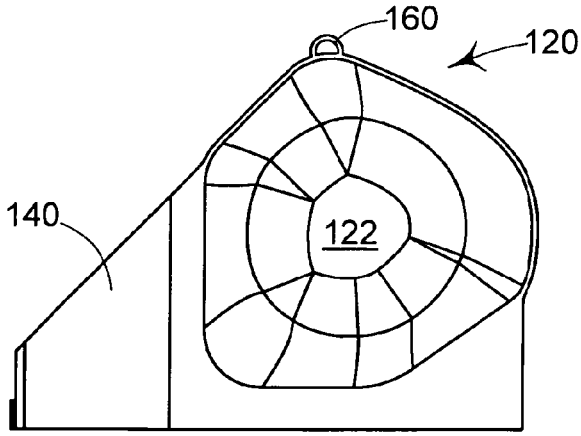
FIG. 6 shows a back elevation view of the exemplary cup of the breast supporter illustrated in FIG. 2.

FIGS. 4-6 illustrate additional elevation views of the first cup 120. FIG. 4 illustrates a front elevation view of the first cup 120. FIG. 5 illustrates a side elevation view of the first cup 120 towards the second edge 132 and the torso portion 140 attached thereto. FIG. 6 illustrates a back elevation view of the first cup 120 showing the inside portion 122 thereof.

With reference to FIG. 1, the second cup 170 is substantially similar to the first cup 120. For illustrative purposes, the second cup 170 will now be described. The second cup 170 may include an inside surface 172 (FIG. 9) and an oppositely disposed outside surface 174. The second cup 170 may define a top portion 176, a bottom portion 178, a first edge 180 and a second edge 182. The top portion 176 may be oppositely disposed from the bottom portion 178. The first edge 180 may be oppositely disposed from the second edge 182. The second cup 170 may be provided with an integrally formed torso portion 190 attached at the second edge 182. As illustrated best in FIG. 9, this torso portion 190 may be formed in a manner that allows it to 'wrap' around the torso of the wearer in a manner that will be described later herein.

As illustrated in FIG. 1, the second cup 170 may be provided with a casing 200 formed therein near the bottom portion 178 of second first cup 170 and extend into the torso section 190. This second cup casing 200 may, for example, be formed by folding the material of the second cup 170 onto itself thereby creating a hollow 'tube' (referred to herein as a casing). This casing 200 extends from the distal end of the second cup torso portion 190 to the second cup first edge 180. For descriptive purposes, the casing 200 will be described as having a first distal end 202 (FIG. 9) located at the second cup torso portion 190 and a second distal end 204 (shown in the detail view of FIG. 1) located at the second cup first edge 180. The casing 200 may be provided with a portion of fastener 206 such as, for example, hook-and-loop material. This fastener 206 may be permanently attached to the casing 200 by common manufacturing processes such as, for example, heat tape, stitching, or the like. This fastener 200 may be referred to herein as a "point of adjustment".

Figure 7:
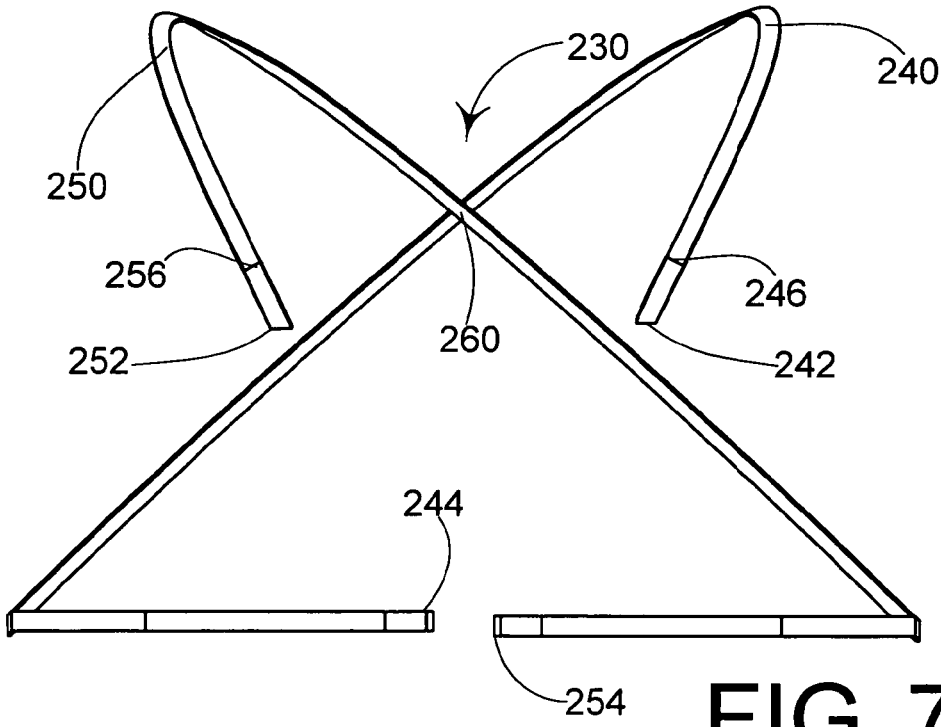
FIG. 7 shows a front elevation view of an exemplary embodiment of a strap assembly utilized in the exemplary breast supporter of FIG. 1.
Figure 8:
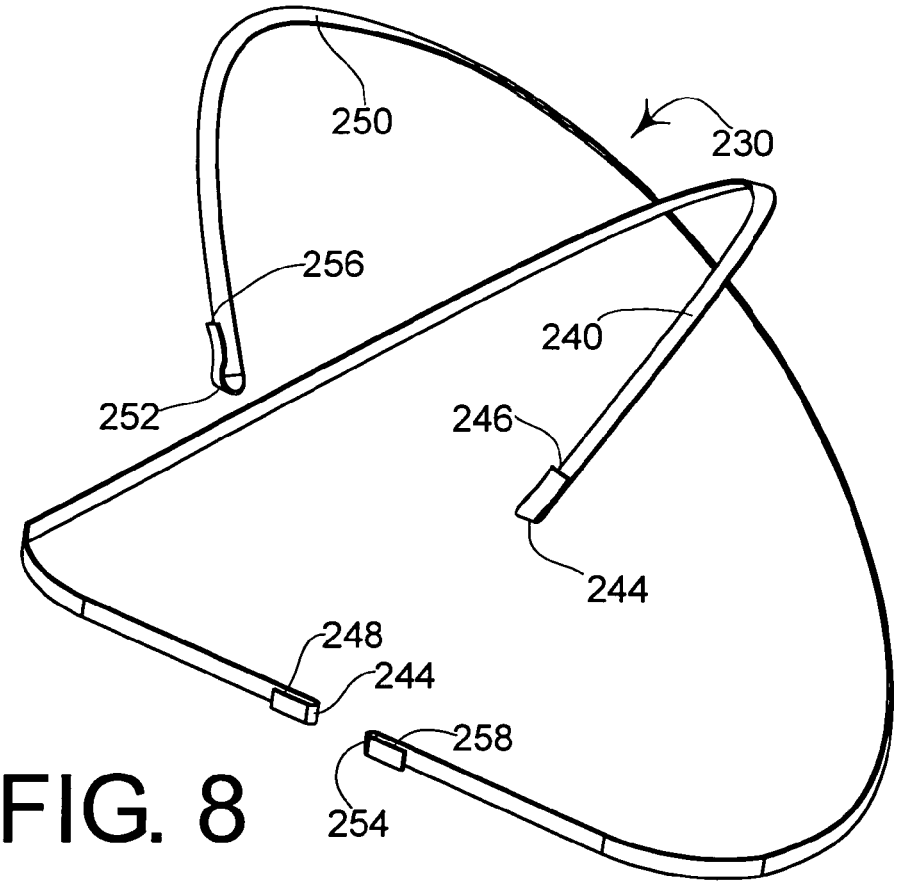
FIG. 8 shows a front-side perspective view of the strap assembly of FIG. 7.
Figure 14:
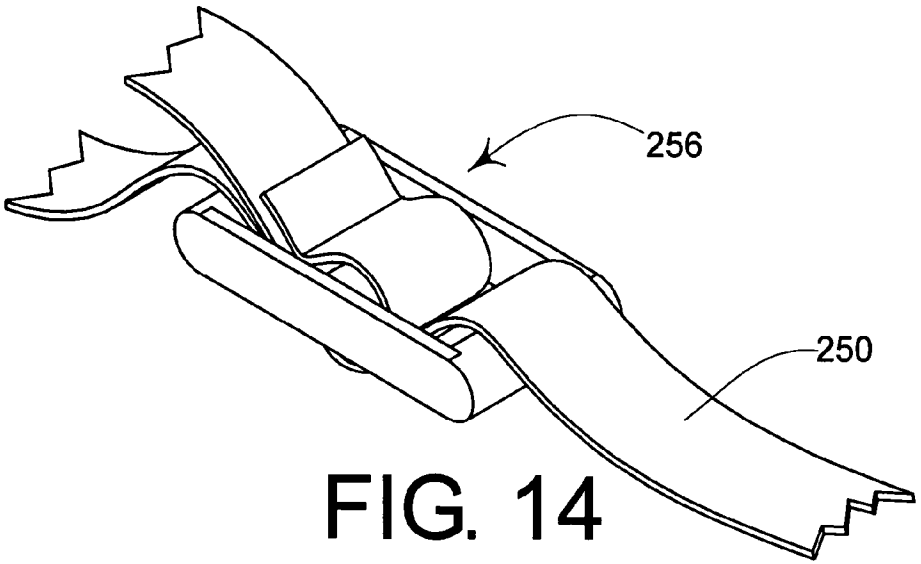
FIG. 14 shows a perspective view of an exemplary slide buckle that may be provided with the exemplary breast supporter of FIG. 1.
Figure 15:
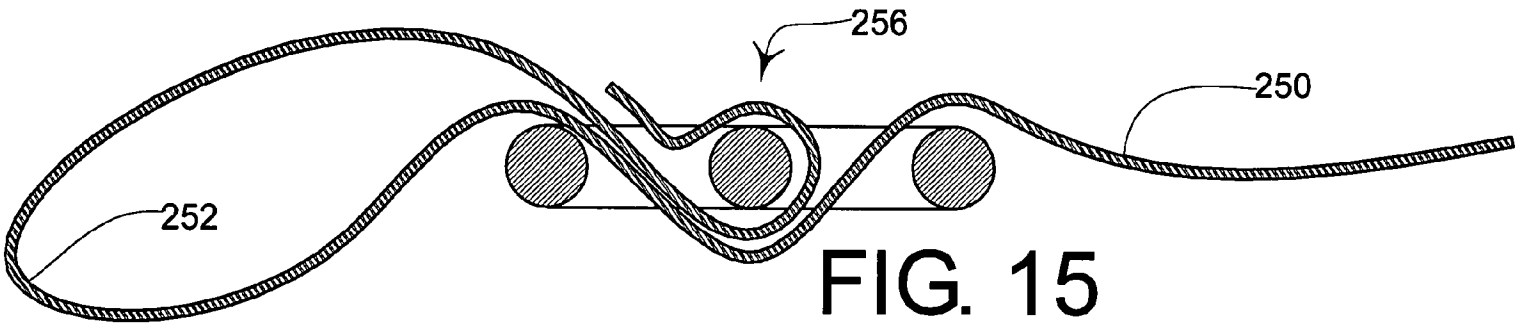
FIG. 15 shows a cross-sectional view of the exemplary slide buckle of FIG. 14.

With continued reference to FIG. 1, the second cup 170 may be further provided with an attachment point 210 formed near the top portion 176. In one exemplary embodiment, the attachment point 210 may be a loop captured by the materials used to construct the breast supporter 100. Additionally, the second cup 170 may be provided with a first pair of loops 212 and a second pair of loops (not shown). These loops 212 may be attached to the outside surface 174 of the second cup near the first edge 180. With reference to FIG. 7 showing a strap assembly 230 consisting of a first strap 240 and a second strap 250. The straps 240, 250 may be made from any of a variety of materials including, but not limited to, cotton, polyester elastic with tricot and spandex. The first strap 240 is provided with a first distal end 242 and an oppositely disposed second distal end 244. The first strap first distal end 242 may be provided with an adjustable attachment mechanism 246 (e.g. a slide buckle 256 as illustrated in FIGS. 14 and 15 or any other adjustable attachment mechanism such as hook-and-loop, clasps, snaps, buttons, tabs, removable rivets, safety pins, clamps. buckles and the like. The first strap second distal end 244 may be provided with a fastener 248 such as hook-and-loop as illustrated in FIG. 8. The second strap 250 is provided with a first distal end 252 and an oppositely disposed second distal end 254. The second strap first distal end 252 may he provided with an adjustable attachment mechanism 256. The second strap second distal end 254 may be provided with a fastener 258 such as hook-and-loop as illustrated in FIG. 8. The strap assembly 230 may be provided with a point of intersection 260 where the first strap 240 is attached to the second strap 250. The point of intersection 260 may include a fastener such as, for example, hook-and-loop, a clasp, a snap, a button, a tab, a rivet, a buckle, or the like. In one exemplary embodiment, the point of intersection is simply stitching utilized to join the first and second straps 240, 250. Having provided a detailed description of exemplary components of the exemplary breast supporter 100, the assembled configuration of the breast supporter 100 will now be provided. With reference to FIG. 1 showing the front-side perspective view of the breast supporter 100, The first cup 120 and the second cup 170 may be readily adjustably attached to each other via the pair of loops 212 and the eyes 162, 164 (FIG. 2). This pair of loops 212 and eyes 162, 164 may be referred to herein as a 'point of adjustment'. This attachment is obviously utilized for securing the cups 120, 170 while being used in a manner that will be described later herein.

With continued reference to FIG. 1, the pair of straps 230 are attached to the cups 120, 170 in a manner that will now be described. The first strap first distal end 242 is attached to the first cup 120 at the attachment point 160. In one exemplary embodiment, this attachment is made by the adjustable attachment mechanism 246. The first strap second distal end 244 is fed into the casing 200 of the second cup 170. One the first strap second distal end 244 is fed completely through the second cup casing 200, the first strap 240 is 'folded' to securely engage the second cup fastener 206 to the first strap fastener 248. In one exemplary embodiment, the second cup fastener 206 is the hook portion of hook-and-loop material and the first strap fastener 248 is the loop portion of hook-and loop material. It should be noted that this attachment of the fasteners 206, 248 provides and adjustable attachment between the first strap 240 and the second cup 170. This adjustable attachment between the first strap 240 and the second cum 170 may be referred to herein as a 'point of adjustment'. In a substantially similar manner, the second strap 250 is attached to the first and second cups 120, 170. The second strap first distal end 252 is attached to the second cup 170 at the attachment point 210. In one exemplary embodiment, this attachment is made by the adjustable attachment mechanism 256. The second strap second distal end 254 is fed into the casing 150 of the first cup 120. The second strap second distal end 254 is fed completely through the first cup casing 150, the second strap 250 is "folded" to securely engage the first cup fastener 156 to the second strap fastener 258 (FIG. 8). In one exemplary embodiment, the first cup fastener 156 is the hook portion of hook-and-loop material and the second strap fastener 258 is the loop portion of hook-and-loop material. It should be noted that this attachment of the fasteners 156, 258 provides and adjustable attachment between the second strap 250 and the first cup 120. This adjustable attachment between the second strap 250 and the first cup 120 may be referred to herein as a 'point of adjustment'.

Figure 9:
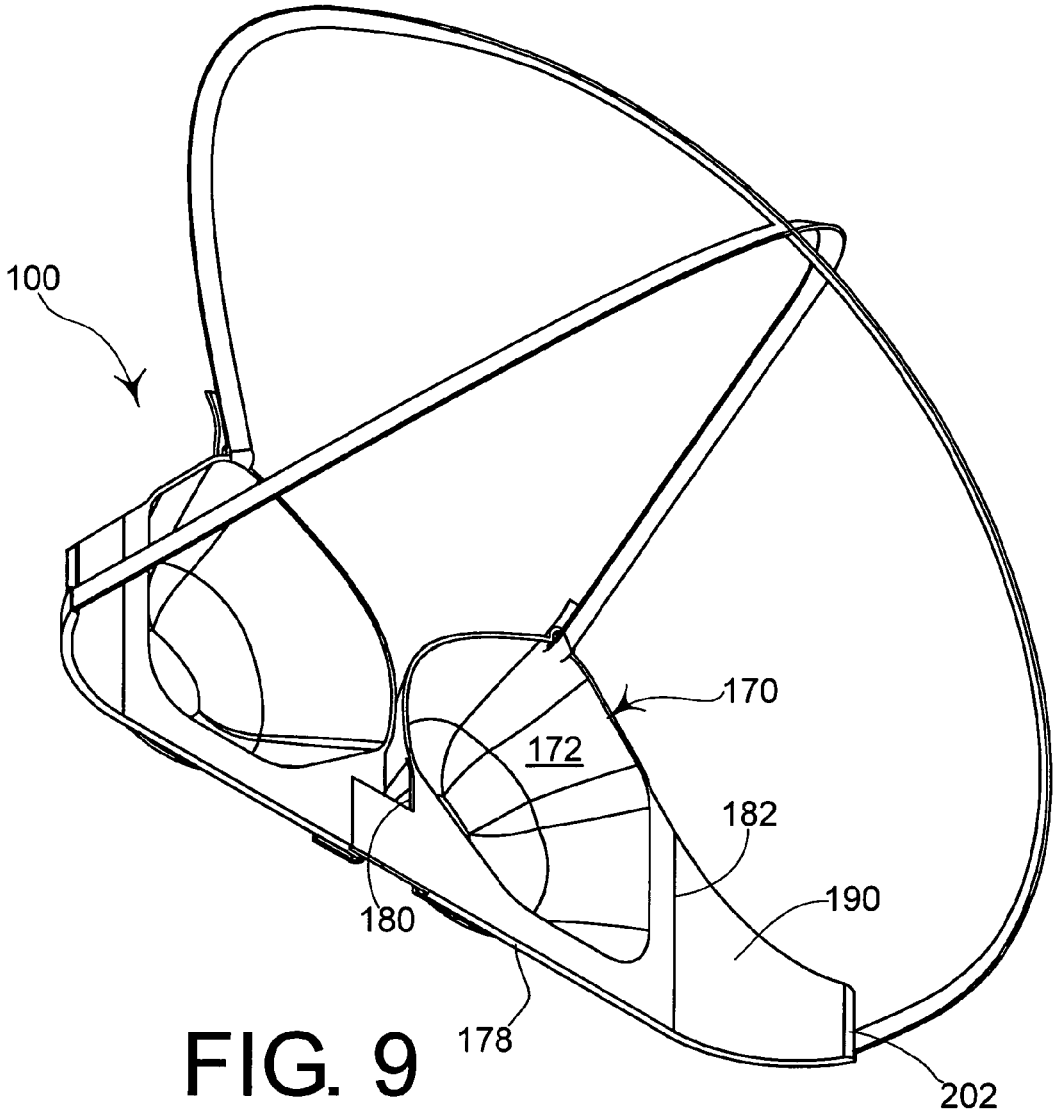
FIG. 9 shows a back-side perspective view of the exemplary breast supporter of FIG. 1.
Figure 10:
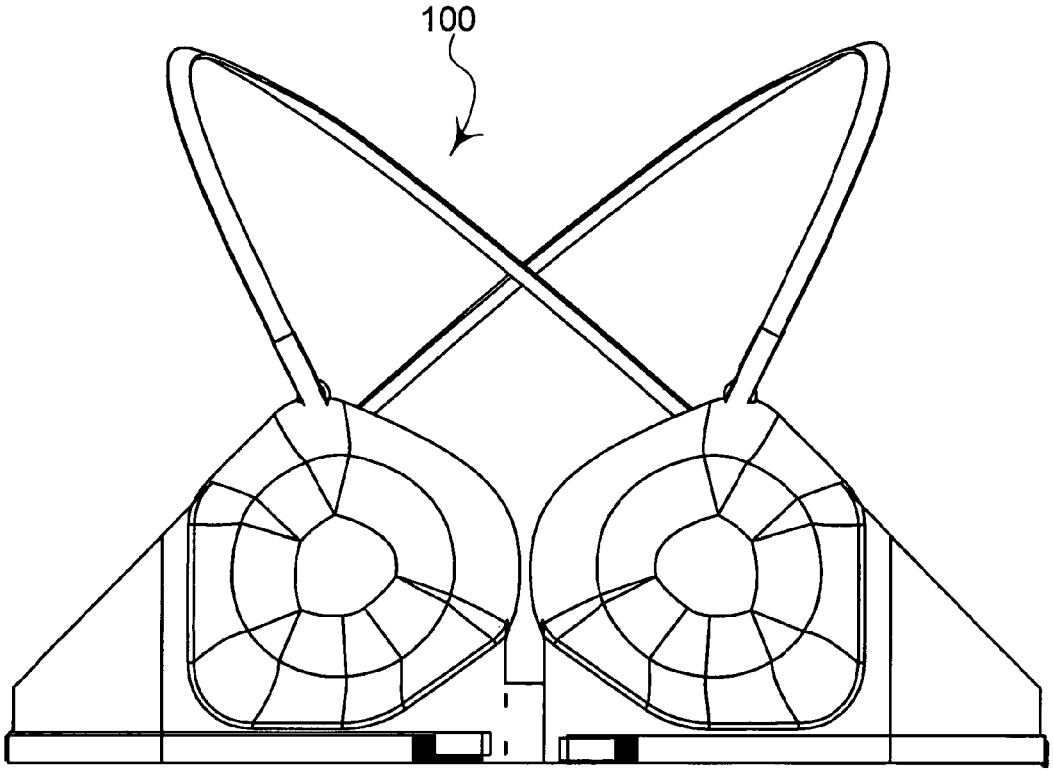
FIG. 10 shows a front elevation view of the exemplary breast supporter of FIG. 1.
Figure 11:
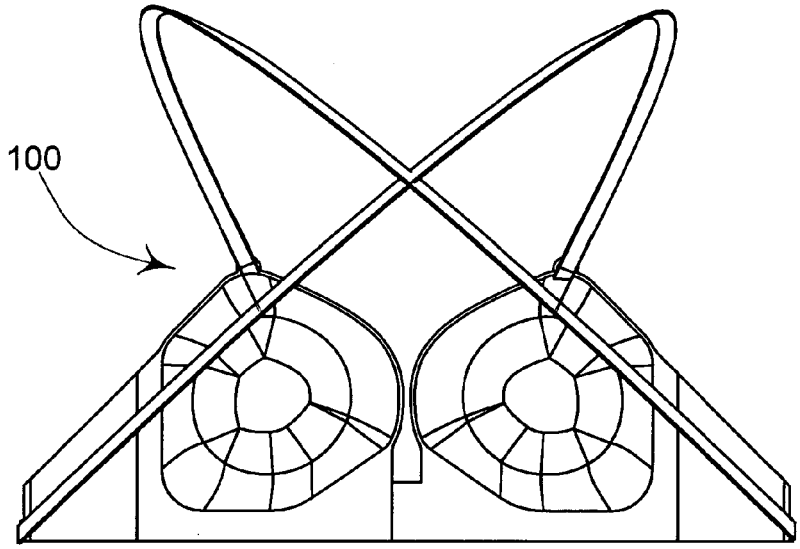
FIG. 11 shows a back elevation view of the exemplary breast supporter of FIG. 1.
Figure 12:
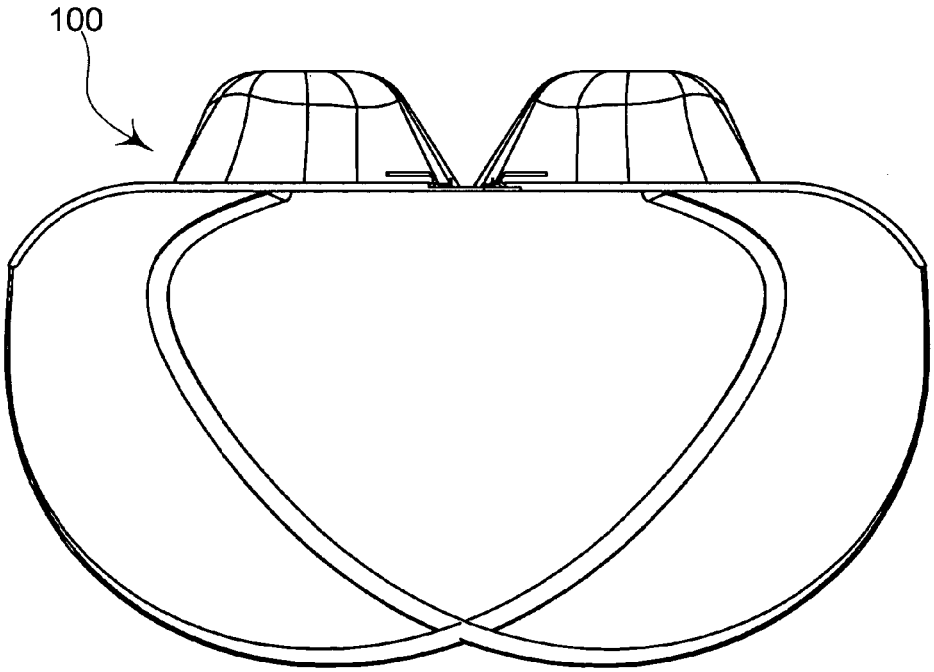
FIG. 12 shows a top plan view of the exemplary breast supporter of FIG. 1.
Figure 13:
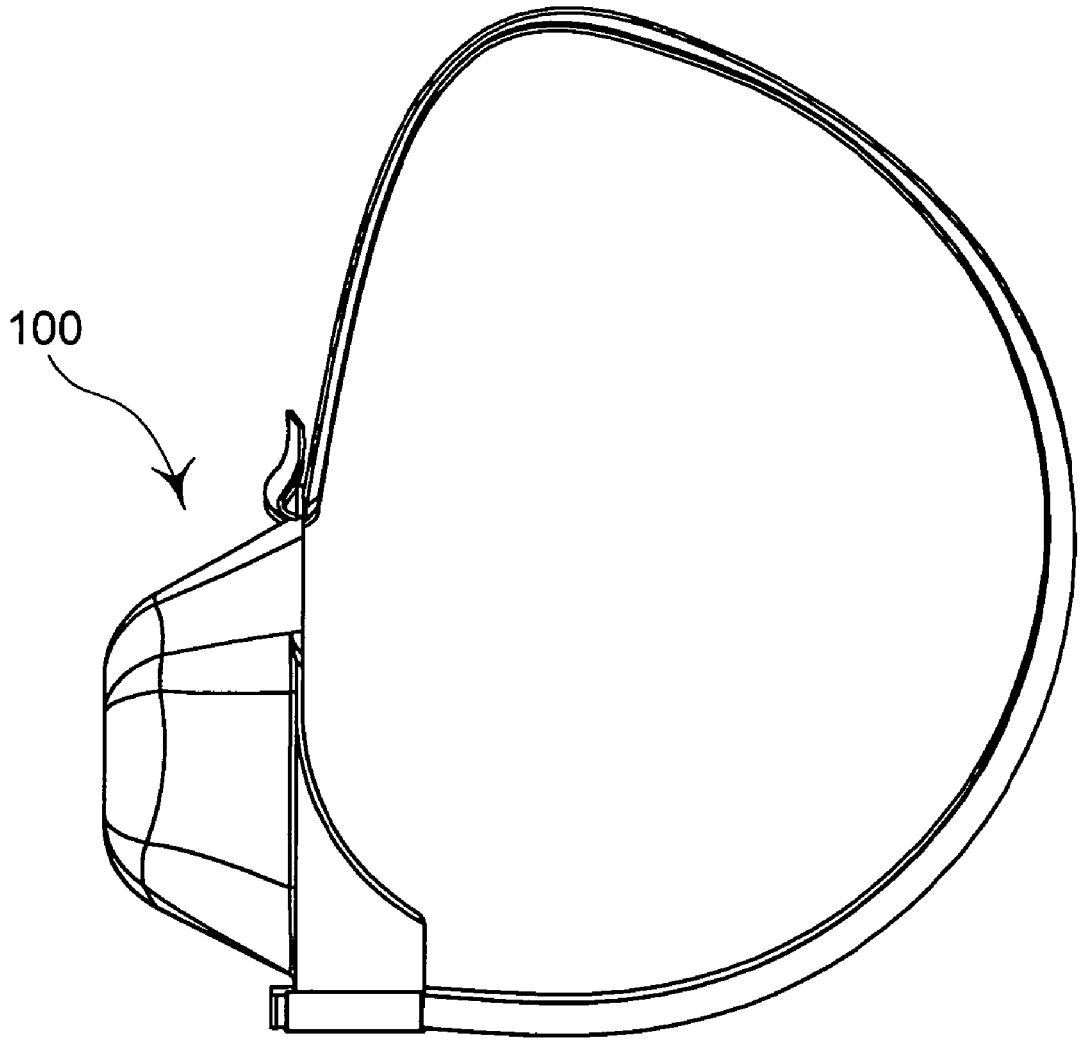
FIG. 13 shows a side elevation view of the exemplary breast supporter of FIG. 1.

Having provided a description of one exemplary assembled configuration of the breast supporter 100, the process of using the breast supporter 100 will now be provided. The wearer of the breast supporter 100 puts it on by passing her left arm through the triangle formed between the first strap 240, the second strap 250 and the first cup 120. The next step is to pass her right arm through the triangle formed between the first strap 240, the second strap 250 and the second cup 170. Having passed both arms through these triangles, the straps 240, 250 are positioned such that the first strap 240 is positioned over the left shoulder of the wearer and the second strap 250 is positioned over the right shoulder of the wearer. Additionally, the point of intersection 260 (FIG. 7) where the first and second straps 240, 250 intersect is located on the back-side of the wearer approximately between the shoulder blades. With the straps properly positioned, the first and second cups 120, 170 are pulled together and attached using the pair of loops 212 and the eyes 162, 164 (FIG. 2). This attachment renders the breasts supported by the breast supporter 100 such that the left breast is adjoining the first cup inside surface 122 (FIG. 2) and the right breast is adjoining the second cup inside surface 172 (FIG. 9). In practice, the adjustment of the breast supporter 100 is relatively easy because (in one exemplary embodiment) the adjustment points are in the front of the wearer where it is relatively easy to adjust the breast supporter 100 while it is being worn. When adjusting the breast supporter 100, the wearer simply manipulates the first strap adjustable attachment mechanism 246 to lift the wearer's left breast. Similarly, when the wearer manipulates the second strap adjustable attachment mechanism 256, the wearer's right breast is lifted. It can be appreciated that this adjustability is improved due to the location of these adjustable attachment mechanisms 246, 256. Additionally, the present breast supporter 100 does not require a constricting band around the torso (whereas traditional breast supporters require a band around the torso). The traditional torso bands increase manufacturing costs, reduce circulation of the wearer, irritate the wearer, etc. In addition to the improvements in comfort, the present invention reduces the number of possible sizes. Traditionally, breast supporters have been sold based on circumferential size around the breasts and the cup size (e.g. 32C, 40D, 30A, etc.). With the present breast supporter 100 only the cup size is required for fitting (e.g. A. B. C, D. etc.). The present breast supporter 100 is more adjustable than traditional breast supporters thereby enabling this sizing scheme to be utilized. It should be noted that there might be the need to sell a variety ranges within each cup size (e.g. C small, C large) wherein one size would be for a first range of circumferential sizes and a second size would be for a second range of circumferential sizes. The benefit to the manufacturer, distributor, retailer and customer are that fewer sizes of the breast supporter 100 need to be made, inventoried, displayed and worn.

The previously presented exemplary embodiments of the present breast supporter 100 are meant to be illustrative embodiments. It will be apparent to those skilled in the art from consideration of the specification disclosed herein that alternative configurations can be designed with the perspective provided herein. For example, the present breast supporter may be configured as a dress, a bra, a brazier, a swimsuit, a bikini, an undergarment, lingerie, or the like. Therefore, this specification is provided for illustrative purposes only, the true scope of the present invention being indicated by the following claims.

We claim:

1. A breast supporter comprising:

a first cup having, a first edge, a second edge, a top portion, and a bottom portion;

a second cup having a first edge, a second edge, a top portion, and a bottom portion wherein said first cup and said second cup are adjacent one to the other with the first edges of each cup detachably attached one to the other;

a first strap comprising a first distal end and an oppositely disposed second distal end wherein said first strap first distal end is attached to the top portion of said first cup and wherein said first strap second distal end is attached to the bottom portion of said second cup; and, a second strap comprising a first distal end and an oppositely disposed second distal end wherein said second strap first distal end is attached to the top portion of said second cup and wherein said second strap second distal end is attached to the bottom portion of said first cup such that said first strap and said second strap cross to form a point of intersection rearward of said first and said second cups.

2. The breast supporter of claim 1 further comprising a first releasable fastener attached between the first distal end of said first strap and said top portion of said first cup; and, a second releasable fastener attached between the first distal end of said second strap and said top portion of said second cup.

3. The breast supporter of claim 1 wherein said first strap and said second strap are fixedly secured to each other at said point of intersection.

4. The breast supporter of claim 1 further comprising a first adjustable attachment device attached between the first distal end of said first strap and said top portion of said first cup; and, a second adjustable attachment device attached between the first distal end of said second strap and said top portion of said second cup.

5. The breast supporter of claim 1 wherein said cups are detachably attached one to the other by a releasable fastener.

6. A breast supporter comprising:

a first cup having a top and a bottom portion;

a second cup having a top and a bottom portion adjacent to said first cup;

a first strap having a first distal end and an oppositely disposed second distal end, wherein said first strap first distal end is attached to the top portion of said first cup and wherein said second distal end, is detachably attached to the bottom portion of said second cup; and, a second strap having a first distal end and an oppositely disposed second distal end wherein said second strap first distal end is attached to the top potion of said second cup and wherein said second distal end is attached to the bottom portion of said first cup, and, wherein said first cup is detachably attached to the second cup and said first strap and said second strap cross rearward of said first and said second cups to form a point of intersection.

7. The breast supporter of claim 6 wherein said straps are fixedly secured to each other at said point of intersection.

8. The breast supporter of claim 6 wherein said first and said second straps are adjustable.

9. The breast supporter of claim 6 wherein said first and said second straps are detachable from said first cup and said second cup by means of a releasable fastener.

10. The breast supporter of claim 6 wherein said first cup is detachably attached to said second cup by means of a releasable fastener.

11. The breast supporter of claim 6 further comprising a first adjustable attachment device attached between the first distal end of said first strap and said top portion of the first cup; and, a second adjustable attachment device attached between the first distal end of said second strap and said top portion of the second cup.

12. The breast supporter of claim 6 further comprising:

a casing formed in the bottom portion of said first cup;

a casing formed in the bottom portion said second cup wherein a portion of said first strap near said second distal end is slidingly disposed within the casing of the first cup; and, a portion of said second strap near said second distal end is slidingly disposed within the casing of the second cup.

13. A breast supporter comprising:

a first cup having a top and a bottom portion;

a second cup, having a top and a bottom portion, positioned adjacent to said first cup and detachably attached thereto;

a first strap comprising a first distal end and an oppositely disposed second distal end, wherein said first strap first distal end is attached to the top portion of said first cup, and wherein said first strap second distal end is attached to the bottom portion of said second cup;

a second strap comprising a first distal end and an oppositely disposed second distal end, wherein said second strap first distal end is attached to the top portion of said second cup, and wherein said second strap second distal end is attached to the bottom portion of said first cup such that said first and second straps form an intersection rearward of said first cup and said second cup.

14. The breast supported of claim 13 wherein said dist cup is detachably attached to said second cup by means of a releasable fastener.

15. The breast supporter of claim 13 wherein said first strap is adjustable.

16. The breast supporter of claim 13 wherein said second strap is adjustable.

17. The breast supporter of claim 13 wherein said first strap and said second strap are fastened at their intersection.

18. The breast supporter of claim 13 further comprising:

a casing formed in the bottom portion of said first cup;

a casing formed in the bottom portion of said second cup wherein the second distal end of the first strap is slidingly disposed within the casing of said second cup; and, the second distal end of the second strap is slidingly disposed within the casing of said first cup.

* * * * *

UNITED STATES PATENT AND TRADEMARK OFFICE

CERTIFICATE OF CORRECTION

PATENT NO. : 8,167,679 B2
APPLICATION NO. : 12/724245
DATED : May 1, 2012
INVENTOR(S) : Paula Saraceno and Karen McLeod It is certified that error appears in the above-identified patent and that said Letters Patent is hereby corrected as shown below:

Title Page, should read;

(12) United States Patent
Saraceno et al.

(75) Inventors: Paula Saraceno, Denver, CO (US);
Karen McLeod, Simi Valley, CA (US)

Signed and Sealed this
Nineteenth Day of June, 2012

David J. Kappos

David J. Kappos
*Director of the United States Patent and Trademark Office*